United States Patent [19]

Onuma et al.

[11] Patent Number: 4,691,869

[45] Date of Patent: Sep. 8, 1987

[54] APPARATUS FOR CONTROLLING THE OPERATION OF A GRINDING SYSTEM

[75] Inventors: Eiichi Onuma, Narashino; Youji Kawamura, Tsukumi; Hiroshi Obana, Narashino; Takemi Aizawa, Funabashi; Motomi Tamai, Tsukumi; Tsuguya Inagaki, Yokohama; Minoru Tokita, Tokyo, all of Japan

[73] Assignees: Onoda Cement Co., Ltd., Yamaguchi; Sankyo Dengyo Co., Ltd., Tokyo, both of Japan

[21] Appl. No.: 888,626

[22] Filed: Jul. 21, 1986

Related U.S. Application Data

[63] Continuation of Ser. No. 610,622, May 16, 1984, abandoned.

[30] Foreign Application Priority Data

May 23, 1983 [JP] Japan ..... 58-90484

[51] Int. Cl.[4] ..... B02C 25/00

[52] U.S. Cl. ..... 241/34; 241/135

[58] Field of Search ..... 241/30, 33, 34, 134, 241/135, 137

[56] References Cited

U.S. PATENT DOCUMENTS

| | | | |
|---|---|---|---|
| 3,314,614 | 4/1967 | Daniel et al. | 241/30 |
| 3,421,703 | 1/1969 | Galer | 241/135 X |
| 4,026,479 | 5/1977 | Bradburn et al. | 241/33 X |
| 4,225,091 | 9/1980 | Steier | 241/30 X |

FOREIGN PATENT DOCUMENTS

| | | | |
|---|---|---|---|
| 2807691 | 4/1979 | Fed. Rep. of Germany | 241/33 |
| 57-194054 | 11/1982 | Japan . | |
| 58-159855 | 9/1983 | Japan . | |
| 717200 | 2/1980 | U.S.S.R. | 241/30 |
| 845847 | 7/1981 | U.S.S.R. | 241/34 |
| 997812 | 2/1983 | U.S.S.R. | 241/30 |

*Primary Examiner*—Howard N. Goldberg
*Assistant Examiner*—Joseph M. Gorski
*Attorney, Agent, or Firm*—Frishauf, Holtz, Goodman & Woodward

[57] ABSTRACT

Apparatus for controlling the operation of a grinding system having a plurality of mills running in a parallel fashion, in which the operating condition of each mill is controlled such that a predetermined physical quantity, which changes dependent on the running condition, is equal to set values for the mills, and the set value for each mill is variably controlled so as to maximize the amount of pulverized material. The apparatus includes means for comparing a pulverizing amount $F_A$ per unit time of the mill under control with that $F_B$ of another mill, and controlling the set value for the mill under control so that a difference between the pulverizing amounts ($F_A - F_B$) is maximized while the set value for the other mill is fixed, whereby the set value of the mill under control is automatically optimized.

7 Claims, 8 Drawing Figures

APPARATUS FOR CONTROLLING THE OPERATION OF A GRINDING SYSTEM

This application is a continuation of application Ser. No. 610,622, filed May 16, 1984, now abandoned.

BACKGROUND OF THE INVENTION

This invention relates to apparatus for controlling the operation of a grinding system and, more particularly, to apparatus for controlling the operating condition of a grinding system containing a plurality of mills operating in a parallel fashion so as to optimize the condition of the grinding system.

A constant feed method based on a constant feed weigher (CFW) has been widely employed for feeding materials, such as minerals, to one of the mills, for example, ball mills, in a pulverizing or grinding system. Recently, a variable control method has superseded the constant feed method, however. In the variable control method, a CFW flow rate is variably controlled so as to make constant a physical quantity such as a sound pressure of the mill under control or a BE current (a drive current) for a bucket elevator for transporting the material. To effect this control, the physical quantity is collected when the grinding system produces a maximum amount of the pulverized material. The physical quantity is used as a set value for operating the grinding system under the optimum operating condition. Many disturbances frequently cause the set value to shift from what has already been set. Examples of those disturbances are change of the nature of the material, aging of balls in the mill, and others. Those disturbances are generalized as a disturbance of the first kind, which will be referred to later. This type of disturbance makes it impossible to constantly place the grinding system under an optimum operating condition.

To cope with this, Japanese Patent Disclosure (KOKAI) No. 57-194054 proposes a unique sound pressure control method which successfully removes the adverse effects caused at the start and stop of the adjacent mills in the grinding system. Another Japanese Patent Disclosure (KOKAI) No. 58-159855 proposes an approach in which a physical quantity such as the BE current and the sound pressure are variable, not fixed. The grinding system is so arranged that the disturbances, which directly influence the physical quantity, are constantly checked and the optimum quantity is automatically found. For prior art discussion, the Japanese Patent Disclosure (KOKAI) 58-159855 will be given in reference to FIG. 1. Sound generated by a ball mill 1 is sensed by microphones 8 set at toward the first and second compartment of the ball mill 1. The output signals containing the information of the sensed sounds, which are produced by the microphones 8, are passed respectively through amplifiers 9 and inverters 10 to an operating unit OP. Clinker, as the pulverized material discharged from the ball mill 1, is transported to a separator 3 by a bucket elevator 2. The clinker is classified by the separator 3 according to particle size. Part of the classified clinker is discharged and used as the product. The remainder is again put into the ball mill 1, by way of a return path 4. Before being put into the ball mill 1, the amount of the clinker, as the pulverized material, is automatically controlled by a controller CONT. Power consumed by the bucket elevator 2 is measured by a wattmeter 7 attached in the motor section (not shown). The measured quantity is then applied to the operating unit OP. A flow rate of the remainder of the clinker, which is returned to the ball mill 1 via the return path 4, is measured by an impact line flow meter 5 and is led to the operating unit OP. The operating unit OP multiplies the detected signals by predetermined coefficients, adds the products of the multiplications, and feeds the result of the addition as a process signal into the grinding system to the controller CONT. A setter, mounted in the controller CONT, contains a set value, or an optimum set value, as set therein to cause the grinding system to produce a maximum amount of the pulverized material. If no disturbance occurs in the grinding system, there is no need for altering the optimum set value. However, the grinding system essentially suffers from many types of disturbances as given below.

(1) Hardness and particle size of the clinker are not invariable. When the clinker is increased in hardness or particle size, the pulverizing rate in the ball mill 1 is reduced. As a result, the clinker discharged into the bucket elevator 2 and transported into the separator 3 contains a relatively large amount of coarse particles, and accordingly the remainder of the clinker increases. Under this condition, if an amount of the clinker fed through the belt scale 6 remains unchanged, the amount of the material under pulverization increases.

(2) Spraying water into the ball mill 1 is often required. In this case, the sound generated in the ball mill 1 changes and the pulverizing rate also changes.

(3) Temperature of the clinker changes. This causes the pulverizing rate to change.

(4) Steel balls in the ball mill 1 are worn. This results in a change of the pulverizing rate.

Many other disturbances are involved in the grinding system. Any type of disturbance, if it occurs, changes an amount of the pulverized material in the ball mill 1, viz., a load of the ball mill 1. Accordingly, an optimum set value for the grinding system is displaced from that already set in the controller CONT.

This follows from a relationship between the load and the pulverizing efficiency of the ball mill 1, as shown in FIG. 2. As seen from FIG. 2, in a range $A_1$, the pulverizing efficiency of the ball mill 1 increases linearly with the increase of the load. In other words, the amount of the product of the ball mill 1 can be improved by increasing an amount of the pulverized material returned and fed back to the ball mill 1 under the control of the belt scale 6. The increase in the amount of this pulverized material is achieved by increasing the output signal, or the set value, of the controller CONT.

In a range $B_1$, the relationship exhibits a reverse tendency to that in the range $A_1$. To increase the pulverizing efficiency, it is necessary to decrease the load of the ball mill 1.

In the graph, $C_1$ represents a point to provide the maximum pulverizing efficiency. A set value for the controller CONT is an optimum set value. The point $C_1$ varies with various conditions in the mill system.

Manual operation, which is time consuming and troublesome, is required to find an optimum set value. Further, for the disturbances spontaneously occurring during an automatic running of the mill system, an operator must constantly supervise the operating state of the system. When such disturbances occur, the operator must again search an optimum set value for the controller CONT at that time.

In the grinding system shown in FIG. 1, to find an optimum set value, a set value for the controller CONT is automatically increased at fixed time intervals. The output signal derived from the controller CONT is integrated over fixed time periods before and after the set value is changed. If the integrated value after the set value change is larger than that before the set value change, the set value is further increased. This value is subjected to a similar comparison to the one just mentioned. Successively, this process is repeated. Then, the grinding system will find a point where the integrated value after the set value change is smaller than that before the set value change. This point is the point $C_1$ on the pulverizing efficiency curve of FIG. 2. Thus, the grinding system confirms that the set value, as set immediately before the final change of the set value, is an optimum set value in the pulverizing system at that time, and sets the controller CONT at that value. In this way, the optimum set value is set in an automatic manner.

The process to find an optimum set value will be described referring to a flow chart shown in FIG. 3.

In a control system, in the grinding system shown in FIG. 1, upon receiving a start signal for automatic correction, the output signal of the controller CONT is integrated over a predetermined period of time. The integrated value $A_2$ is stored in a proper memory. Then, the set value is automatically increased. When the control system in the grinding system, set at the new set value, settles down in operation, the output signal of the controller CONT is again integrated over a predetermined time period. The integrated value $B_2$ is stored in the memory. Those integrated values $A_2$ and $B_2$ are compared with each other. If the comparison result is $B_2 \geqq A_2$, the operation flow returns to a start point a2 in the flow chart. Conversely, if $B_2 < A_2$, after the control system in the grinding system settles down at the new set value, the output signal of the controller CONT is integrated over a predetermined time period. The result of the integration, as the value $C_2$, is stored. Further, the values $B_2$ and $C_2$ are compared with each other. If $C_2 \geqq B_2$, the operation flows back to a point b2. If $C_2 < B_2$, it returns to the point a2. Change of the integrating time and the set value depends on the conditions of the control system in the grinding system.

In this way, the set value for the mill system is automatically corrected, so that the output of the controller CONT is always kept at the highest production.

This excellent mill control method involves the following problems, however. The mill control system is neither an effective control against a process fluctuation (the disturbance of the second kind), from which every type of control method suffers, nor against the disturbances which last for a time period shorter than a response time of the mill control system. Also, the method has the problem that value is often set in the wrong direction.

The disturbance of the first kind is defined as the disturbance which will shift an optimum set value, which provides maximum pulverizing amount of the material, in the direction of increasing or decreasing the set value, horizontally in FIG. 4. The disturbance of the second kind is defined as the disturbance which will shift, regardless of the set value, in the direction of increasing or decreasing the pulverizing amount of the material, vertically in FIG. 5. Usually, this disturbance of the second kind occurs in and is common to all the parallel operating mills in a grinding system.

SUMMARY OF THE INVENTION

It is, therefore, an object of the present invention to provide a new and improved apparatus for controlling the operation of a grinding system which is free from the disturbance of the second kind, which is harmful in optimizing the operating condition of the grinding system, including means for changing a control set value for the grinding system and providing a control apparatus which exactly and quickly finds an optimum set value for the grinding system.

According to the present invention, there is provided apparatus for controlling the operation of a grinding system having a plurality of mills operating in a parallel fashion, in which the operating condition of a mill is by appropriate means such that a predetermined physical quantity, which changes depending on the operating condition, is equal to the set value for the mill, and the set value for the mill is variable controlled so as to maximize an amount of pulverized material; the apparatus including means for comparing the amount pulverized of material $F_A$ per unit time period of the mill under control with that $F_B$ of another mill, and controlling the set value for the mill under control so that a difference between the amount of pulverized material $(F_A - F_B)$ is maximized while the set value for the other mill is fixed.

The control apparatus for operation of a grinding system thus arranged can remove the disturbance of the second kind, which is very detrimental to optimizing the operating condition of a grinding mill having a plurality of parallel operating mills, by controlling a set value for the mill under control, and can accurately and quickly find an optimum set value for the mill under control.

BRIEF DESCRIPTION OF THE DRAWINGS

The present invention can be understood by reference to the accompanying drawings, in which.

DETAILED DESCRIPTION OF THE PREFERRED EMBODIMENTS

Figure 1:
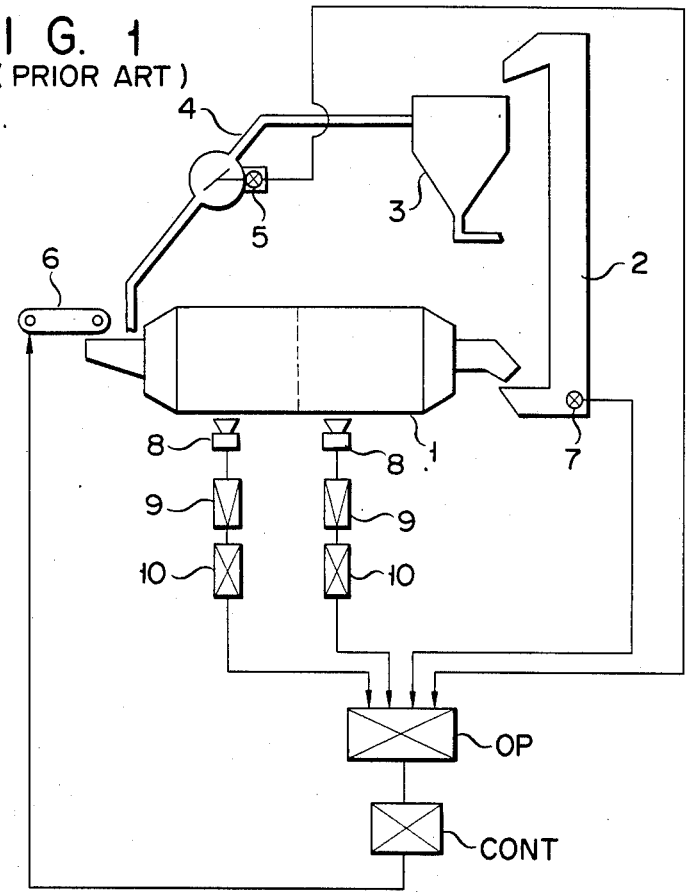
FIG. 1 (PRIOR ART)
FIG. 1 shows a schematic diagram illustrating a grinding system and a sound pressure control system, which are contained in a conventional grinding system.
Figure 2:
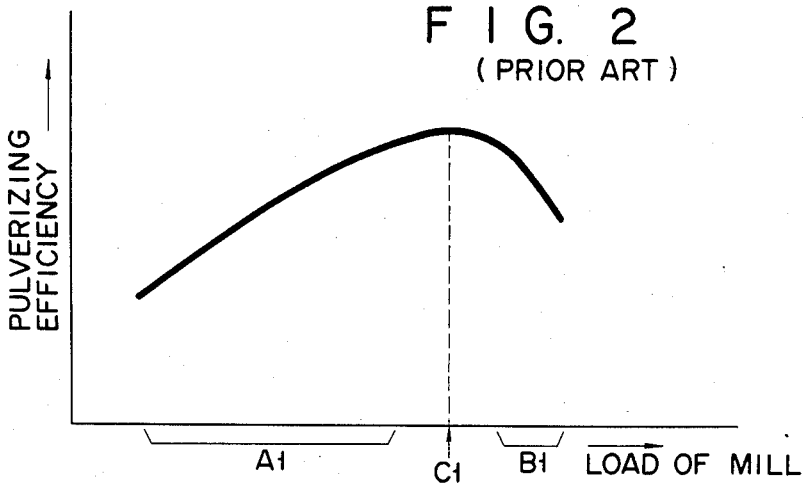
FIG. 2 (PRIOR ART)
FIG. 2 is a graphical representation of a relationship of the load and pulverizing efficiency of the mill shown in FIG. 1.
Figure 3:
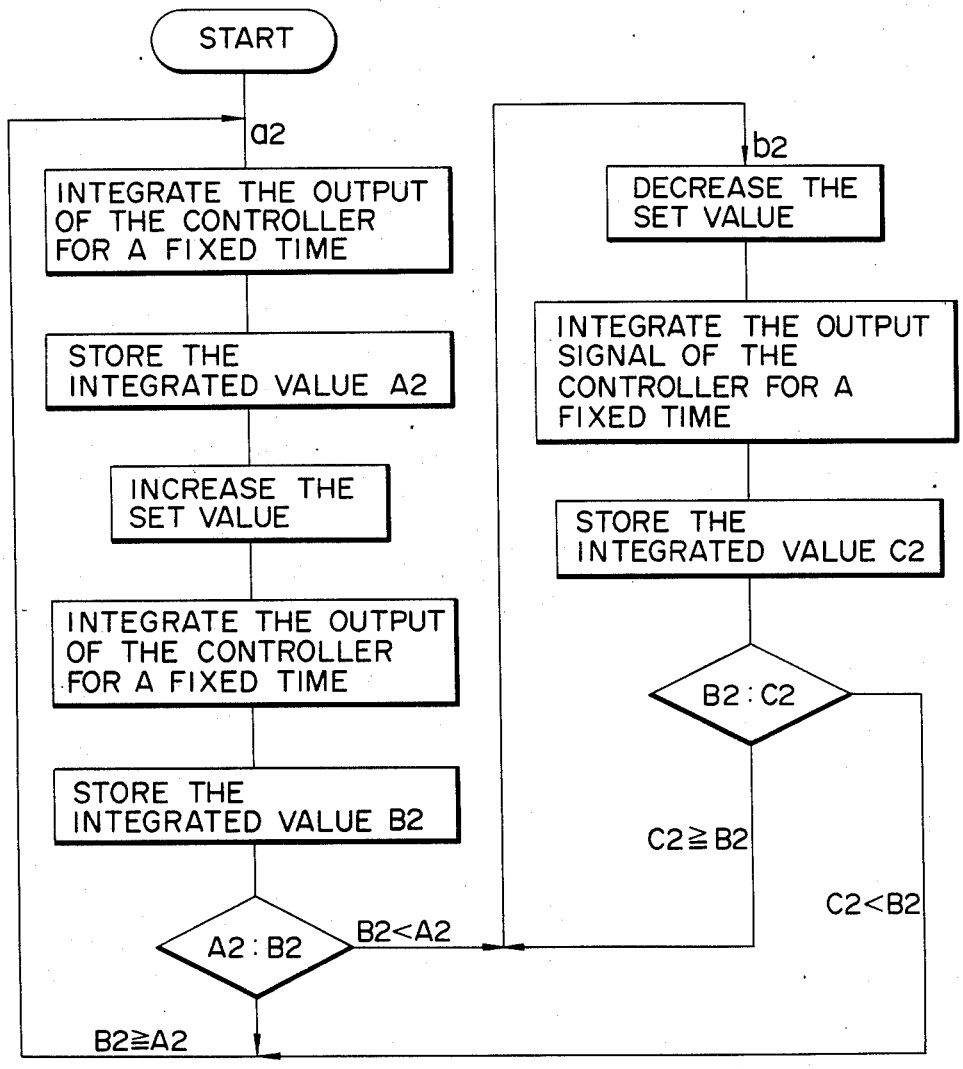
FIG. 3 (PRIOR ART)
FIG. 3 shows a flow chart useful in explaining how to find an optimum set value for the mill by a controller of the grinding system shown in FIG. 1.
Figure 4:
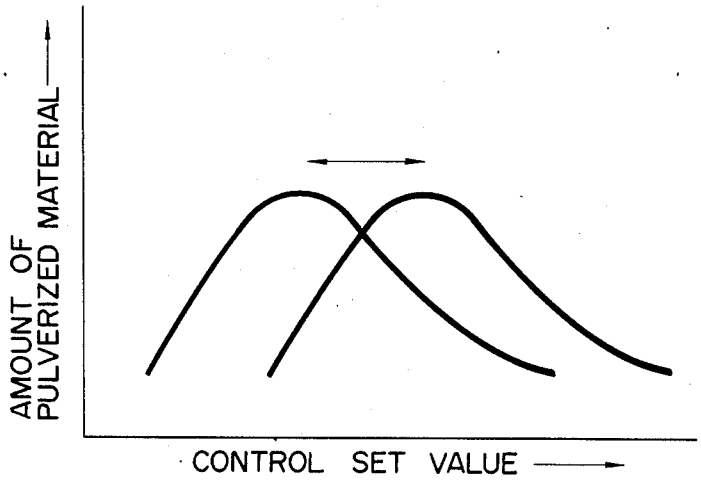
FIG. 4 (PRIOR ART)
FIGS. 4 and 5 graphically illustrate how two types of disturbances shift an optimum set value for the mill differently.
Figure 5:
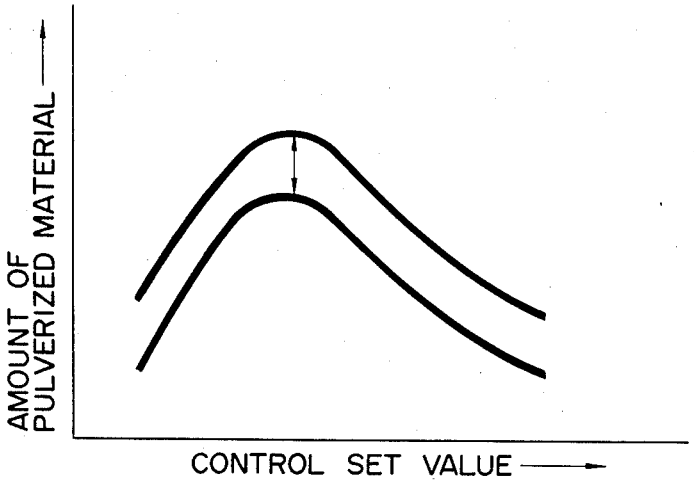
FIG. 5 (PRIOR ART)
Figure 6:
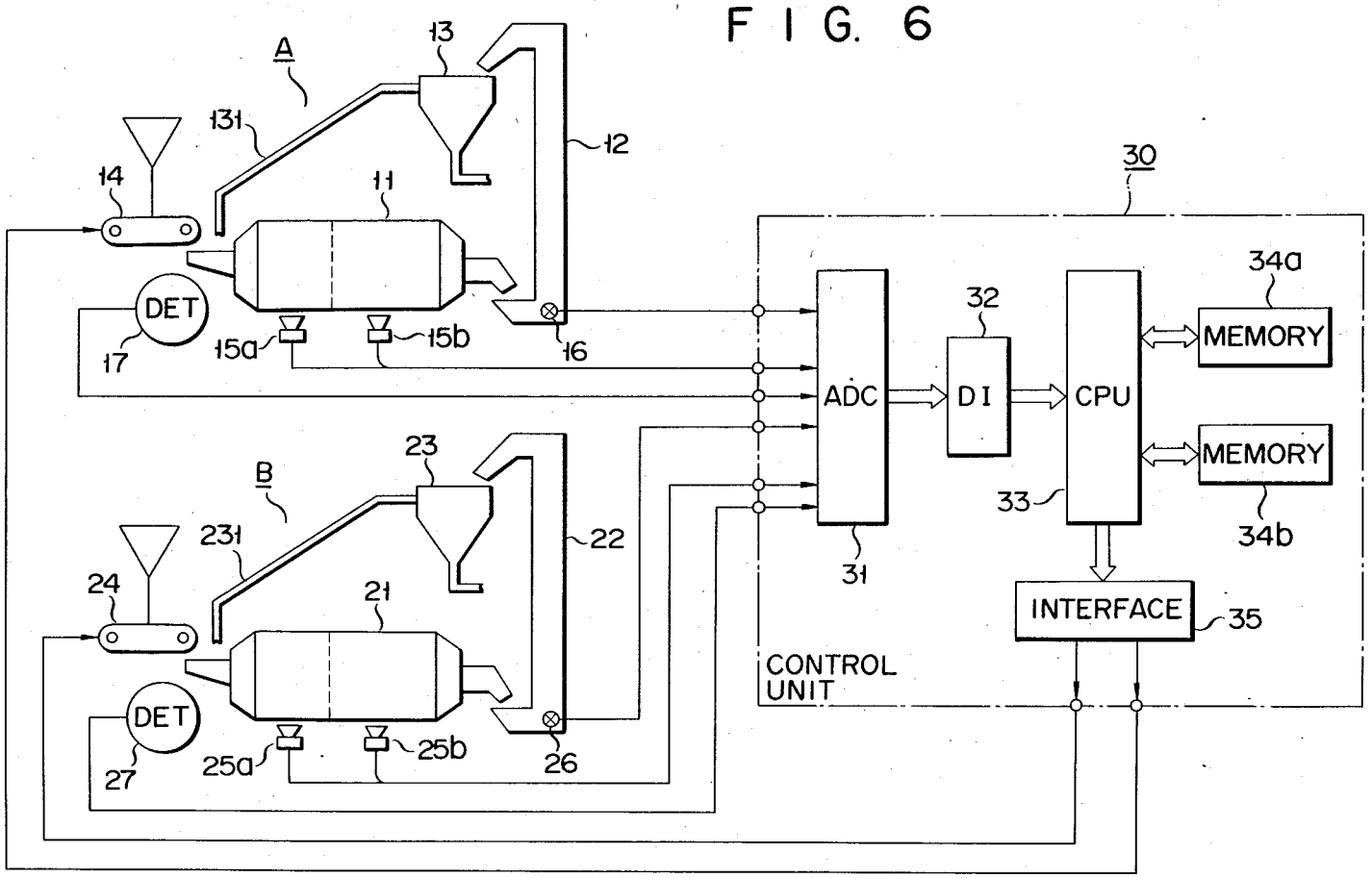
FIG. 6 is a schematic diagram of a grinding system with apparatus for controlling the operation of the grinding system according to the present invention.

Reference is made to FIG. 6 which illustrates a grinding system incorporating apparatus for controlling the operation of a grinding system according to the present invention. In the figure, A and B respectively designate first and second mill sections making up the mill system. The first mill section A is made up of a ball mill 11, a bucket elevator (BE) 12, a separator 13, a belt scale 14, and microphones 15*a* and 15*b*. For example, clinker, as the pulverized material, is discharged from the ball mill 11 and transported by the BE 12 to the separator 13. In the separator 13, the clinker is separated according to particle size, and the separated part is discharged and used as the product, while the remainder is returned through a return path 131 to the ball mill 11. The clinker is put into the mill 11 through a belt scale 14 in an amount determined by a control unit 30 to be described later. The BE 12 is provided with a current detector 16 for detecting a drive current or a BE current of a motor as a drive source (not shown).

The second mill section B is made up of a ball mill 21, a BE 22, a separator 23, a return path 231, a belt scale 24, microphones 25*a* and 25*b*, and a current detector 26. The output signals, representing sound pressures produced by the microphones 15*a*, 15*b*, 25*a*, and 25*b*, and the output signals or the BE current signals, are connected to the control unit 30.

Further, detectors 17 and 27 are respectively contained in the first and second mill sections A and B. Each of the detectors 17 and 27 are for detecting a specific power consumption E obtained by respectively dividing each power consumption of the motors (not shown) for driving the mills 11 and 21 by each pulverizing amount of the mills 11 and 21. The output signals, each representing the specific power consumption E and output from the detectors 17 and 27, are also applied to the control unit 30.

The control unit 30 is a computer system comprising an analog-to-digital converter (ADC) 31, a digital input unit (DI) 32, a central processing unit (CPU) 33, memories 34*a* and 34*b*, and an interface 35. An input signal to the control unit 30 is digitized by the ADC 31 and applied to the CPU 33 through the DI 32. The CPU 33 performs many operations containing a so called PID operation on the basis of the input signal and the set values stored in the memories 34*a* and 34*b* as described later. The CPU 33 produces a CFW flow rate signal, which in turn is applied through an interface 35 to the belt scales 14 and 24.

Figure 7:
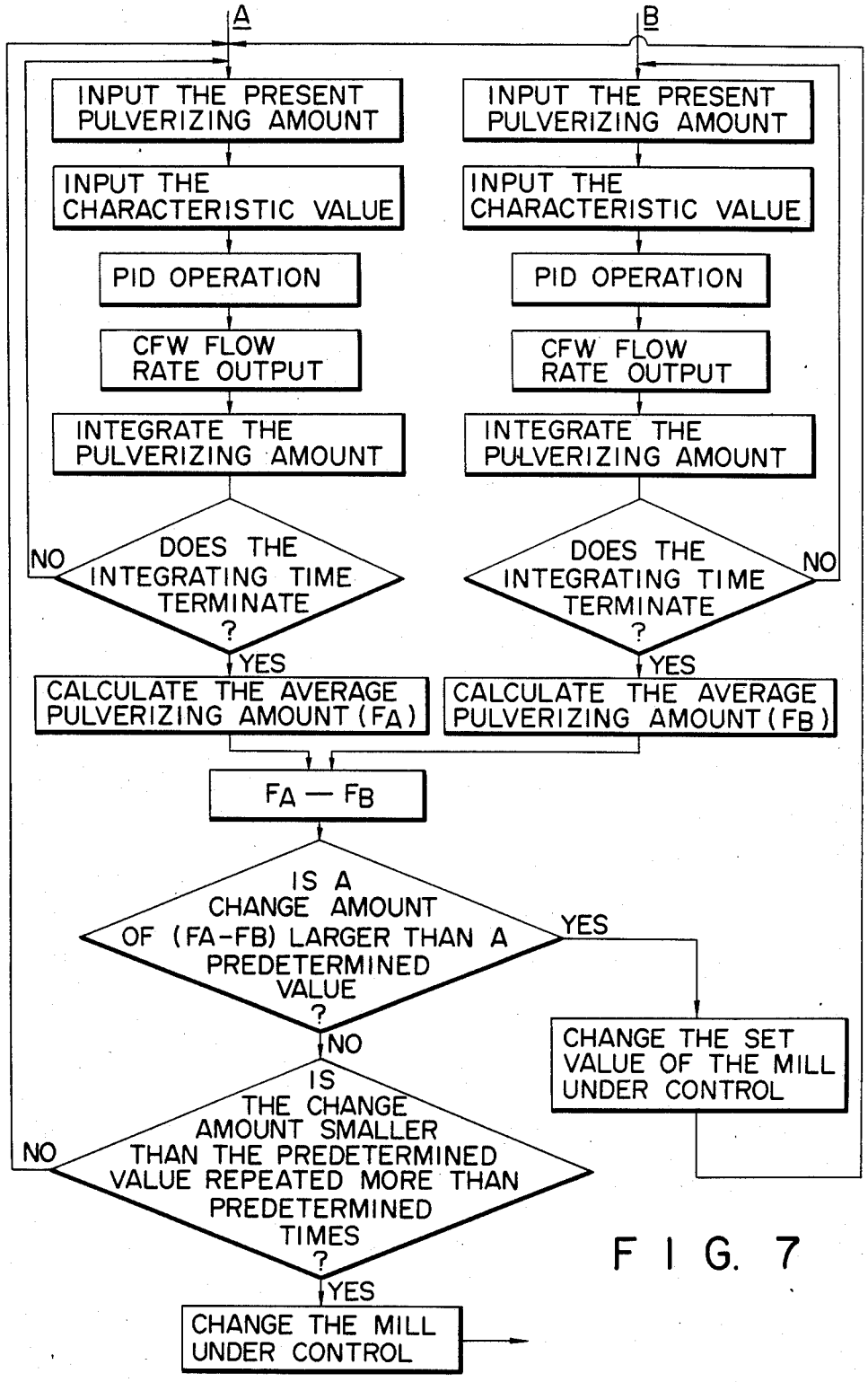
FIG. 7 shows a flow chart useful in explaining how to control the running of the grinding system of FIG. 6.

Operation of the present apparatus for controlling the mill system will be described referring to the flow chart shown in FIG. 7.

It is assumed that a control set value (BE current or sound pressure) for the ball mill 11 in the first mill section A is stored in the memory 34*a* of the control unit 30. It is further assumed that a control set value for the mill 21 in the second mill section B is stored in the memory 34*b* of the control unit 30. The characteristic values of the mills 11 and 21, such as sound pressure or BE current, are gathered by the microphones 15*a*, 15*b*, 25*a* and 25*b* or the current detectors 16 and 26. Those characteristic values are input to the CPU 33. The CPU 33 performs the PID operation based on the characteristic values as input and the set values read out from the memories 34*a* and 34*b*, and produces CFW flow rate control signals for transmission to the belt scales 14 and 24. The control signals are used for controlling the amount of clinker fed to the mills 11 and 21 so that the characteristic values of the mills 11 and 21 are equal to the set values, respectively. The CPU 33 integrates the pulverizing amounts of the mills 11 and 21 over a fixed time period, for example, one hour, and then calculates average pulverizing amounts $F_A$ and $F_B$ (the pulverizing amount per unit time) of the mills 11 and 21 on the basis of the integrated values.

Then, the CPU 33 compares the average pulverizing amounts $F_A$ and $F_B$ to produce a difference therebetween. Assume now that the mill 11 in the first pulverizing section A is to be controlled. The CPU 33 calculates $(F_A-F_B)$ and compares it with that obtained in the previous comparison. It is judged whether or not a changed amount in the difference $(F_A-F_B)$ is $1-5\%$, for example, larger than a predetermined value. If the changed amount is larger than the predetermined value, the CPU 33 changes the set value for the mill 11 in the first pulverizing system, and returns to the start step of this processing flow. In this case, the set value is changed so that the difference $(F_A-F_B)$ becomes large. When the changed amount is smaller than the predetermined value, the above process is repeated a predetermined number of times with the same set value. If the state exists in which the changed amount is smaller than the predetermined value and is successively continued in several comparing steps, three or four steps, for example, it is considered that the set value for the mill 11 in the first mill section A reaches the optimum value. At this time, the mill under control is switched from the mill 11 to the mill 21. Then, the above procedure of changing the set value and comparing it with that in the previous step is continued until an optimum set value of the mill 21 is found. In this case, the difference of the pulverizing amounts is given by $(F_B-F_A)$.

When the optimum set value of the mill 21 is found, the mill 21 as the mill under control is switched again to the mill 11. Subsequently, the above procedural steps are repeated. In this way, the mills 11 and 21 are always kept at the optimum set values, respectively, so the mill system containing the mills 11 and 21 is operated at the optimum operating condition.

Figure 8:
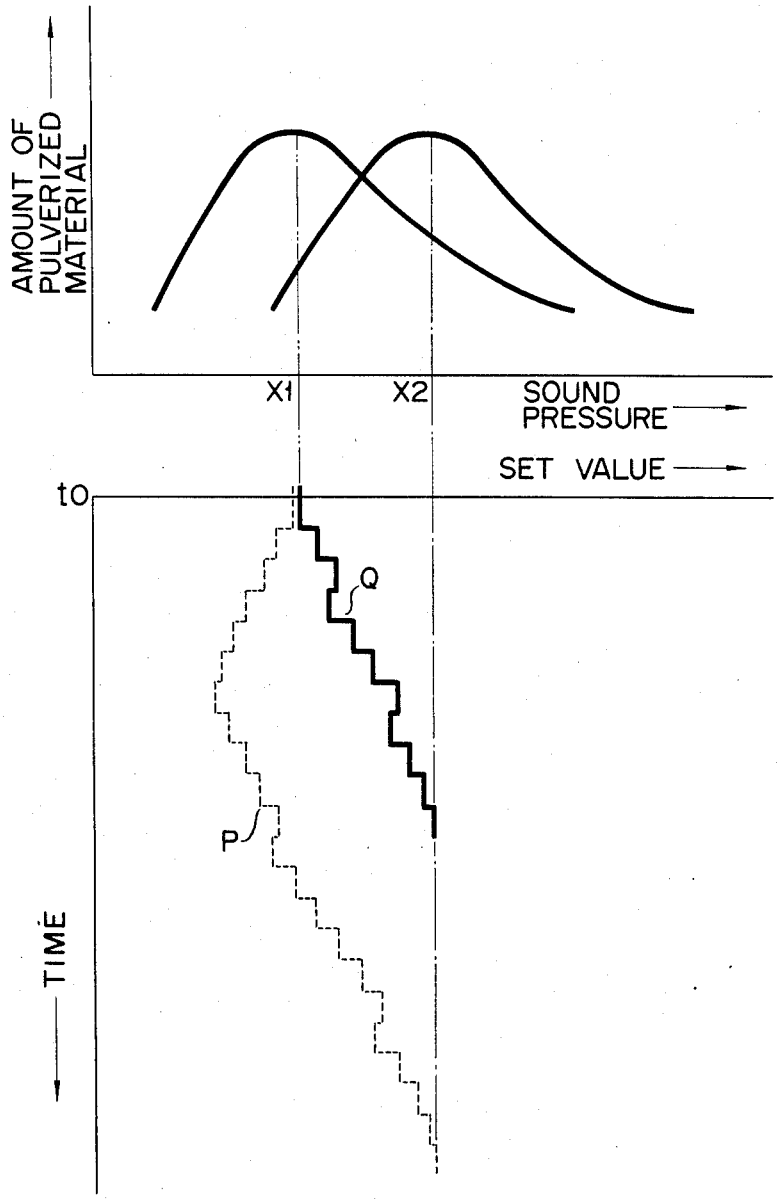
FIG. 8 graphically illustrates the effects attained by the control apparatus according to the present invention.

As seen from the foregoing description, the optimum set values for the mills 11 and 21 can be found accurately and quickly. Therefore, the mills 11 and 21 can be operated at high efficiency and with stability. This useful effect of the present invention will be described in detail referring to FIG. 8.

Let us assume that the mill has run at an optimum sound pressure point $x_1$ till a time point $t_o$, but an amount of mineral as fed changes, so that the optimum point greatly shifts from $x_1$ to $x_2$. It is further assumed that, at this time, the disturbance of the second kind, which increases the pulverizing amounts of all the mills, comes in the grinding system. In the prior method, it is frequently interpreted that the control system per se makes the sound pressure relatively low, thereby to increase the pulverizing amounts. In this case, the disturbance continuously decreases the sound pressure set value during the period of increasing slope, so that the set value is greatly displaced from the true optimum point $x_2$. As a result, much labor is required to find the true optimum point $x_2$. This state is as illustrated by a broken line P in FIG. 8. On the other hand, with the apparatus according to the present invention which evaluates a pulverizing amount difference between the adjacent mills, the harmful disturbance of the second kind, equally applied to the mills, is of no consequence. Therefore, it is possible to quickly find the new optimum point $x_2$, as illustrated by a solid line Q in FIG. 8. Our experiment has shown that, for the disturbance of a frequency comparable to the sampling period (corresponding to the integrating period), the present embodiment more quickly finds the optimum point than the prior art.

It should be understood that the present invention is not limited to the above mentioned embodiment. For example, the ball mill as the pulverizing apparatus may be replaced by any other suitable apparatus, such as a roll mill and a tube mill. Further, the number of mills may be increased, if necessary. In such a case, to find the optimum set value, a set value for a mill under control is altered on the basis of a pulverizing amount difference between the mill under control and another mill, for example, the adjacent mill, in the grinding system. In this way, the mill under control is switched from one to another successively. The physical quantity used for the set value, although it is the BE current or the sound pressure in the above embodiment, may be replaced by any quantity if it is dependent on the running condition of the mill, for example, BE motor load. Furthermore, the pulverizing amount as the evaluation value may be relaced by a specific power consumption E which is about inversely proportional to the pulverizing amount. In this case, the difference of the specific power consumptions ($E_A-E_B$), in place of the difference of the pulverizing amounts ($F_A-F_B$), is minimized. The present invention may be variously changed and modified within the scope of the present invention.

For example, when the adjacent mill stops, the control is automatically changed from a control mode to maximize the pulverizing amount difference ($F_A-F_B$) to another control mode that, with $F_B=0$, the set value for the mill under control is varied so as to maximize the pulverizing amount $F_A$. And when the adjacent mill starts its operation, the control is automatically returned to the control mode to maximize the difference ($F_A-F_B$) when the necessary data on that mill are all gathered.

To improve the accuracy of the comparison, the two set values $X_1$ and $X_2$ for the comparison of ($F_A-F_B$) are gathered several (n) times. Then, the gathered set value data $X_1$ and $X_2$ are averaged. The averaged data are used for the comparison. More specifically, for three times of data gathering, for example, the data gathering is performed in the order of $X_1-X_2-X_1-X_2-X_1-X_2$, thereby to have data of $f_{1,1}$, $f_{1,2}$, $f_{2,1}$, $f_{2,2}$, $f_{1,3}$, $f_{2,3}$, where $(F_A-F_B)=f$. Comparison is then made between $$\sum_{i=1}^{3} f_{1,i} \text{ and } \sum_{i=1}^{3} f_{2,i}.$$

A set value for the mill under control is varied so that $$\sum_{i=1}^{3} f_{2,i}$$

is maximized through the above comparison process.

In the above-mentioned embodiment, the pulverizing amounts $F_A$ and $F_B$, which are used for the comparison of ($F_A-F_B$), are those integrated over a predetermined period of time. Alternatively, each integrating time period is divided into a plurality of segments, for example, 6 segments. The maximum and minimum integrated values of these six integrated segments are deleted, and the remaining four integrated values are averaged. The averaged one is used for the value $F_A$. This process is correspondingly applied for the adjacent mill.

In another modification of the apparatus, at the start of the operation of the mill under control, the material is fed for a fixed period of time (3–10 minutes) and at a fixed pulverizing amount, as given by the pulverizing amount stored immediately before the mill is stopped. Then, the CPU enters the control phase based on the set value of the sound pressure or the BE current.

In a further modification of the apparatus, as for the sound pressure control, when the sound pressure actually measured falls and indicates a predetermined value or a given level, e.g. 60%, of a target sound pressure, such a state of the mill is considered as "mill clogging", and the feeding of the material is stopped. And, when the sound pressure again rises and reaches another given level, e.g. 80%, of the target sound pressure, the control is automatically returned to the normal sound pressure control mode.

Furthermore, means to protect the mill under control from the noise generated by the adjacent mill, may be employed. To realize this, a microphone for noise removal is additionally provided and faces toward the adjacent mill direction. The noise component affected by the adjacent mill is constantly subtracted from the output signal of the microphone, which is provided for collecting always properly and automatically the sound generated by the mill under control.

As described above, according to the present apparatus for operation of a grinding system, an optimum set value of a physical quantity such as BE current or sound pressure can be accurately and quickly found. Accordingly, it is possible to maintain the grinding system at high efficiency and stability. When a disturbance of the type, which increases the pulverizing amounts of all the mills in the grinding system, is entered into the grinding system, in the conventional control arrangement not based on a comparison of the set values of two mills, it is judged that the set value control before the disturbance is entered, viz., the control by increasing or decreasing the set value, is correct even if the pulverizing condition is set up in any way. Therefore, the set value is further increased as long as the disturbance exists. When the disturbance disappears, the set value has been greatly displaced from the true optimum set value. On the other hand, in the present invention, such a disturbance or a disturbance of the second type, is nullified by the comparison of the set values of the two mills. Because the disturbance is erased, displacement of the set value from the true one is relatively small, so that the set value may be quickly set to the optimum one.

What is claimed is:

1. Apparatus for controlling operation of a dry type grinding system, comprising:

at least a first dry type grinding mill and a second dry type grinding mill arranged to be operated in a parallel fashion;

first material supplying means for supplying material to be pulverized to the first mill, and second material supplying means for supplying material to be pulverized to the second mill;

first detecting means for detecting a first characteristic value of a physical quantity corresponding to an amount of material pulverized per unit time in the first mill, and second detecting means for detecting a second characteristic value of a physical quantity corresponding to an amount of material pulverized per unit time in the second mill, wherein said characteristic values vary according to operation conditions of the first and the second mills;

first memory means for storing a first initial setting value of a physical quantity corresponding to an amount of material desired to be pulverized per unit time in the first mill, and second memory means for storing a second initial setting value of a physical quantity corresponding to an amount of material desired to be pulverized per unit time in the second mill;

first control means for performing a predetermined computation between the initial setting value stored in the first memory means and the characteristic value detected by the first detecting means, and for performing a predetermined computation between the initial setting value stored in the second memory means and the characteristic value detected by the second detecting means, and for producing a first control signal for controlling amounts of material supplied from the first and the second material supplying means so that the first setting value coincides with the first characteristic value, and so that the second setting value coincides with the second characteristic value;

first calculating means for calculating an amount of material pulverized in the first mill per unit time according to the characteristic value detected by the first detecting means, and for calculating an amount of material pulverized in the second mill per unit time according to the characteristic value detected by the second detecting means;

second calculating means for calculating a difference between the amount of material pulverized in the first mill per said unit time and the amount of material pulverized in the second mill per said unit time as calculated by the first calculating means;

third calculating means, associated with said second calculating means, for calculating an amount of variation between said difference between the amounts of material pulverized for a previous said unit time prior to a present said unit time as calculated by said second calculating means, and the difference between the amounts of material pulverized for the present said unit time as calculated by said second calculating means;

means for judging if the amount of variation calculated by the third calculating means is greater or smaller than a predetermined value;

second control means for producing a second control signal which, when said amount of variation is judged by the judging means as being greater than the predetermined value, causes only the initial setting value stored in one of the first and the second memory means to be changed so that the difference between the amounts of material pulverized in the first mill and the second mill as calculated at a next said unit time following the present said unit time by the second calculating means is greater than that at the present said unit time, and so that the amounts of material supplied by the first and the second material supplying means are selectively controlled; and third control means for producing a third control signal which, when said amount of variation is judged by the judging means as being smaller than the predetermined value, causes only the initial setting value stored in the other of the first and the second memory means to be changed so that the difference between the amounts of material pulverized in the first mill and the second mill as calculated at the next said unit time by the second calculating means is greater than that at the present said unit time, and so that the amounts of material supplied by the first and the second material supplying means are selectively controlled;

wherein pulverizing efficiency of each of said first and said second mills is optimized continuously, and disturbances to the mills of the kind which equally affect production efficiencies of the mills are without influence on the changing of the setting values by the second and the third control means.

2. Apparatus according to claim 1, wherein said first calculating means includes means for performing a computation with the first characteristic value set as zero when the first mill is stopped, and for performing a computation with the second characteristic value set as zero when the second mill is stopped.

3. Apparatus according to claim 1, wherein said first calculating means includes means for calculating an average value of the amount of material pulverized over a plurality of unit times.

4. Apparatus according to claim 1, further comprising:

fourth calculating means for calculating a level at which at least said first characteristic value is less than a first predetermined fraction of the first setting value, or said second characteristic value is less than a first predetermined fraction of the second setting value, and for providing a corresponding output;

fourth control means, responsive to the output of said fourth calculating means, for producing a fourth control signal which sets to zero the amount of material supplied by the first material supplying means when the first characteristic value is less than the first predetermined fraction of the first setting value, and which sets to zero the amount of material supplied by the second material supplying means when the second characteristic value is less than the first predetermined fraction of the second setting value;

fifth calculating means, associated with said fourth control means, for calculating a level at which at least said first characteristic value regains a second predetermined fraction of the first setting value, or said second characteristic value regains a second predtermined fraction of the second setting value, and for providing a corresponding output; and fifth control means, repsonsive to the output of said fifth calculating means, for producing a fifth control signal which returns to an original amount value the amount of material supplied by the first material supplying means when the first characteristic value regains the second predetermined fraction of the first setting value, and which returns to an original amount value the amount of material supplied by the second material supplying means when the second characteristic value regains the second predetermined fraction of the second setting value.

5. Apparatus according to claim 1, wherein said first calculating means includes means for calculating an amount of pulverized material at each of a number of times into which said unit time is divided, and for calculating an average intermediate value by detecting maximum and minimum values of amounts of pulverized material as calculated over said number of times.

6. Apparatus according to claim 1, further comprising:

third memory means for storing an amount of material pulverized by the first mill per unit time as calculated by said first calculating means, and fourth memory means for storing an amount of material pulverized by the second mill per unit time as calculated by said first calculating means, when said first and said second mills are both stopped; and sixth control means for producing a sixth control signal which permits the amounts of material supplied by said first and said second material supplying means to be controlled for a predetermined time during which said first setting value is changed to the pulverized amount per unit time stored in the third memory means, and during which said second setting value is changed to the pulverized amount per unit time stored in the fourth memory means, when said first and said second mills are both restarted, and for the setting values to be changed to the initial setting values after said predetermined time.

7. Apparatus according to claim 1, wherein said first and said second detecting means and said first calculating means are arranged to eliminate any effects of interaction noises between said first and said second mills, in the first and second characteristic values.

* * * * *